US009592439B2

(12) United States Patent
VanBuskirk et al.

(10) Patent No.: US 9,592,439 B2
(45) Date of Patent: Mar. 14, 2017

(54) AUTOMOBILE RACING BOARD GAME

(71) Applicants: LuAnn VanBuskirk, Newaygo, MI (US); Vince K. VanBuskirk, Newaygo, MI (US)

(72) Inventors: LuAnn VanBuskirk, Newaygo, MI (US); Vince K. VanBuskirk, Newaygo, MI (US)

( * ) Notice: Subject to any disclaimer, the term of this patent is extended or adjusted under 35 U.S.C. 154(b) by 0 days.

(21) Appl. No.: 14/335,568

(22) Filed: Jul. 18, 2014

(65) Prior Publication Data

US 2015/0021853 A1 Jan. 22, 2015

Related U.S. Application Data

(60) Provisional application No. 61/856,035, filed on Jul. 18, 2013.

(51) Int. Cl.
*A63F 3/00* (2006.01)
*A63F 11/00* (2006.01)

(52) U.S. Cl.
CPC *A63F 3/00082* (2013.01); *A63F 2003/00492* (2013.01); *A63F 2003/00716* (2013.01); *A63F 2003/00858* (2013.01); *A63F 2011/0069* (2013.01)

(58) Field of Classification Search
CPC ..... A63F 3/00082; A63F 2003/00492; A63F 2003/00858; A63F 2003/00716; A63F 2011/0069
USPC ..... 273/246, 248
See application file for complete search history.

(56) References Cited

U.S. PATENT DOCUMENTS 3,223,420 A * 12/1965 Turner ..... A63F 3/00091 273/148 A
3,951,412 A 4/1976 Adams
3,954,268 A 5/1976 Zyla
4,003,577 A * 1/1977 Bolach ..... A63F 3/00006 273/143 R
4,049,274 A 9/1977 Jevons
4,062,545 A 12/1977 Witney
4,114,891 A * 9/1978 Lawrimore ..... A63F 3/00091 273/250
4,264,074 A 4/1981 Sobajima
4,624,463 A 11/1986 Glennon
4,917,386 A 4/1990 Tozer
4,995,611 A * 2/1991 Goldthorpe ..... A63F 7/0017 108/19

(Continued)

*Primary Examiner* — Vishu Mendiratta
(74) *Attorney, Agent, or Firm* — Hultman Law, PLC; Eric Andrew Hultman, Esq.

(57) ABSTRACT

A game and method for playing a game are provided which simulates car racing. The game is played by placing a number of position marking indicators onto a playing surface representing a race track having a pit row, a forward slide, a backward slide, a number of special instruction squares and a start/finish line. Each player takes turns moving their position marking indicators on the playing surface according to a roll of a pair of dice. Players landing on special instruction squares, slides, or card pickup locations will follow the instructions given the board or card. Gameplay is varied by allowing the players to draft other cars, and through special modifiers such as rubbing and roll cards. The game is won by the first player to complete the race by crossing the start/finish after a set number of laps and after visiting pit row at least one time.

10 Claims, 18 Drawing Sheets

(56) References Cited

U.S. PATENT DOCUMENTS

| | | | | | |
|---|---|---|---|---|---|
| 5,048,841 | A | | 9/1991 | Manney et al. | |
| 5,092,605 | A | | 3/1992 | Hoffman | |
| 5,114,152 | A | | 5/1992 | Rouse et al. | |
| 5,116,061 | A | * | 5/1992 | Zentner, Jr. | A63F 3/00094 273/241 |
| 5,139,267 | A | | 8/1992 | Trevisan | |
| 5,322,293 | A | | 6/1994 | Goyette | |
| 5,350,178 | A | | 9/1994 | Hollar | |
| 5,551,698 | A | | 9/1996 | Lyon | |
| 5,560,609 | A | | 10/1996 | Grant | |
| 5,749,582 | A | * | 5/1998 | Fritz | A63F 3/00082 273/246 |
| 5,934,673 | A | | 8/1999 | Telarico et al. | |
| 6,095,522 | A | | 8/2000 | Spell et al. | |
| 6,464,223 | B2 | | 10/2002 | Rutter | |
| 6,471,209 | B1 | | 10/2002 | Barshinger | |
| 6,764,076 | B2 | | 7/2004 | Merritt | |
| 6,834,856 | B2 | * | 12/2004 | Wilson | A63F 3/00082 273/236 |
| 6,979,000 | B1 | * | 12/2005 | Vahala | A63F 3/00082 273/236 |
| 7,261,296 | B1 | | 8/2007 | Duncan | |
| 7,758,046 | B2 | | 7/2010 | Moats | |
| 7,934,724 | B1 | * | 5/2011 | Esquivel | A63F 3/00075 273/241 |
| 7,946,587 | B1 | * | 5/2011 | Renfro | A63F 3/00094 273/241 |

* cited by examiner

AUTOMOBILE RACING BOARD GAME

CROSS REFERENCE TO RELATED APPLICATION

This application is a non-provisional application claiming priority to an earlier filed U.S. provisional patent application entitled, "GAME AND METHOD FOR PLAYING A GAME," filed Jul. 18, 2013, and assigned Ser. No. 61/856,035, the contents of which are incorporated herein by reference.

BACKGROUND OF THE INVENTION

Field of the Invention

This invention relates to games in general, more particularly to board games, and specifically to board games comprising a playing surface having a continuous path along which playing pieces are moved according to the result of a randomizing device, a set of instructional cards, and instructions placed along the path on the playing surface.

Brief Discussion of the Related Art

Board games featuring a playing surface with position markers forming a closed or circuitous path are generally known in the art. Some of these games include a theme of a race, wherein the first player to move a marker onto or across a certain location on the game board, wins the game. Generally, games of this nature use a randomizing device to control the movement of the player's position marker around the circuit's position marking indicators. One example of a randomizing device is a die, or pair of dice, which when rolled, indicates player movement. However, dice alone add an insufficient degree of variability to the game. The invention described herein adds a new degree of variability and strategy, thereby improving game play over that shown in the prior art.

SUMMARY OF THE INVENTION

According to one embodiment of the invention, a game is provided which simulates a car race by providing a playing surface imprinted with indicia representing a closed circuit race track having a plurality of adjacent lanes, each lane further divided into a plurality of individual position markers. The track further comprises a pit row and a start/finish line. The players are each given one of a plurality of position marking indicators representing their current position on the individual position markers. The game further includes a set of instructional cards which are used to modify game play, the set including a deck of dice cards and a deck of track cards.

A pit status indicator is provided to each player at the beginning of the game indicating that the individual player must enter pit row at least once in order to win the game, the pit status indicator is removed when the player enters pit row for the first time. In order to prevent too many trips to pit row, a completed pit indicator is provided on the second visit to the pits, indicating that an individual player has reached the maximum number of visits to pit row and may disregard further game instructions regarding visiting pit row.

The game uses a random number generator to dictate how far an individual may move during their turn, subject to the instructional indicia upon which a player may land. Exemplary indicia include directing the players to complete an action, such as taking a track card, taking a dice card, moving backwards, sliding forward, sliding backwards, and a lucky dog instruction which multiplies the player's next roll by a fixed amount.

According to another form of the invention, a game is provided which simulates a car race by providing a playing surface imprinted with indicia representing a closed circuit race track having a plurality of adjacent lanes, each of the lanes further divided into a plurality of individual position markers, wherein the race track further comprising a pit row, and a start/finish line.

The players each receive one of a plurality of car shaped position marking indicators representing the player's current position on the individual position markers. The game includes several decks of instructional cards including: dice cards; track cards; rubbing cards; and roll cards. The players can keep track of their progress by using a set of lap indicators to indicate the number of times each player has crossed said start finish line. The players each receive a pit status indicator at the beginning of the game indicating that the individual player must enter pit row at least once in order to win the game. The pit status indicator is removed when the player enters pit row for the first time. If a player enters the pit two times, a completed pit indicator is given to the player indicating that the individual player has reached the maximum number of visits to pit row and may disregard further game instructions regarding visiting pit row.

The player's movement is dictated by the results of a roll on a pair of six sided dice. Further, some of the game board's individual position markers contain instructional indicia directing the players to complete an action such as taking a track card, taking a dice card, moving backwards, sliding forward, sliding backwards, and a lucky dog space which multiplies the player's next roll by a fixed amount. Further, some of the instructional indicia are operable only during the final lap of the game.

Dice cards may be received by landing on specific individual position markers having like indicia, or by rolling a roll of twelve on said pair of six sided dice. The dice cards include instructions for a player to: move forward; move backward; enter pit row as soon as possible; and to cause a 'yellow flag' condition, wherein all position marking indicators are formed into two rows directly behind the lead player's position marking indicator according to their current race position, and wherein the last position marking indicator passed by the lead car, if currently behind the lead car by one lap, is moved behind all players on the same lap as the lead car, and is given an updated lap indicator showing that he is now on the same lap as the lead car.

Track cards include instructions for a player to: move forward; move backward; lose a turn; gain an extra turn; acquire a free draft pass card allowing a player to move along with an adjacent player's position marking indicator without forfeiting their next turn; and to cause a 'yellow flag' condition, wherein all position marking indicators are formed into two rows directly behind the lead player's position marking indicator according to their current race position, and wherein the last position marking indicator passed by the lead car, if currently behind the lead car by one lap, is moved behind all players on the same lap as the lead car, and is given an updated lap indicator showing that he is now on the same lap as the lead car.

Additional one time use cards add strategy to the game and include a Rubbing card which is provided to each player at the beginning of the game and allows a first player to stop the forward motion of a second player's position marking indicator when they pass adjacent to the first player's position is marking indicator. Similar in nature, is the one time use Roll card which is provided to each player at the beginning of said game and allows a player to adjust the total of a dice roll increasing or decreasing the total by one as needed to get the desired result.

According to still another form of the invention, a method for playing a game is provided which simulates the racing of a car around a track. The game is played by providing a playing surface imprinted with indicia representing a closed circuit race track having a plurality of adjacent lanes, each of the lanes further divided into a plurality of individual position markers, wherein the race track further has a pit row, and a start/finish line. The players are each given a position marking indicator representing the player's position on one of the individual position markers. A set of instructional cards are also provided and include: dice cards; track cards; rubbing cards; and roll cards. Further, a set of lap indicators is provided to indicate the number of times each player has crossed said start/finish line. A pit status indicator is also provided to each player at the beginning of the game, the indicator showing that the individual player must enter pit row at least once in order to win the game, the pit status indicator is then removed when the player enters pit row for the first time. The game further includes a completed pit indicator showing that the individual player has reached the maximum number of visits to pit row and may disregard further game instructions regarding visiting pit row. The game uses a pair of six sided dice to determine movement. Gameplay is varied by providing a number of individual position markers which contain additional instructional indicia directing the players to complete a particular action, such as taking a track card, taking a dice card, moving backwards, sliding forward, sliding backwards, and multiplying the player's next roll by a fixed amount.

To begin the game, a pit boss distributes one rubbing cards, one roll cards, one pit status indicator and one position marking indicators to each player. The players roll the pair of six sided dice to determine which player has the highest roll, this player becomes the lead player. If there are ties, they are resolved by re-rolling, wherein the higher roll gets the next highest position. Players continue to roll until all players have established their hierarchy, said hierarchy determining the order the players will play during the start of the game.

Each player then places their position marking indicators onto the individual position markers located behind said start/finish line according to the player's hierarchy. The player then begins by rolling the dice to determine a numerical amount of player movement and then moving their individual position markers around the track according to the numerical amount indicated. If a player rolls a double twos, threes, fours or fives on a pair of six sided dice (a roll of 2-2, 3-3, 4-4, 5-5) the player will roll and move again; if the player rolls double 1's (1-1), the player may roll the dice two extra times and may ignore any penalties including backwards movement, losing a turn, and pit cards during both free rolls; a roll of double sixes (6-6) will allow the player to move normally and then to roll again, however before the player rolls and moves for the second time, the player must take and act upon the instructions of a dice card. If the player's rolls totals three (1-2 or 2-1), the player may choose to move forward three spaces, or may elect to re-roll the dice, wherein if said re-roll is doubles (1-1, 2-2, 3-3, 4-4, 5-5, 6-6) the player will move backwards the total of the dice, however if said re-roll was non-doubles, the player will move forward a total of twice the amount of the higher die roll.

After moving, the player determines if they landed on instructional indicia. If so, they must act according to the instructions on the individual position markers. A player's turn ends after movement, and following any instructions, and the player passing the dice to the next player in the hierarchy. These steps are repeated by each of the players, in turn, until one player completes a predetermined number of laps around the track and has completed at least one trip through pit row, wherein that player is the winner of the game.

Different variations of the game and its method may be implemented by varying the styles, colors, playing pieces, as well as the shape, length and number of lanes on the game board, as may suit the end user. The examples provided above are given merely to enable the invention and should not be read to be limiting. The foregoing and other objects, features, and advantages of the invention will become more apparent from the following description and from the claims.

BRIEF DESCRIPTION OF THE DRAWING FIGURES

Various illustrative systems, methods, devices, features, and advantages of the invention are described below with reference to the appended drawings, which may not be drawn to scale and in which like parts are designated by like reference designations, wherein.

DESCRIPTION OF THE VARIOUS EMBODIMENTS

Figure 1:
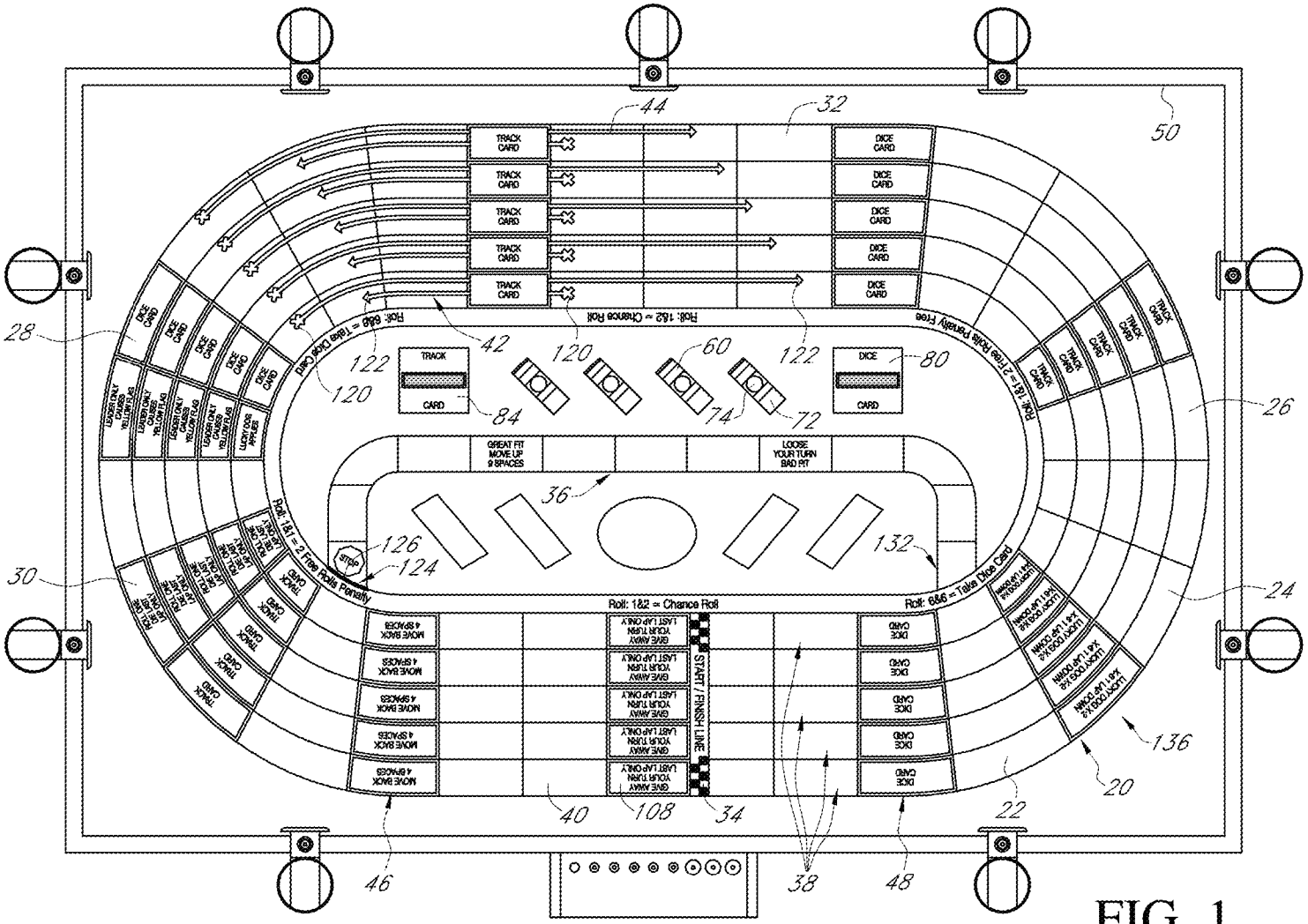
FIG. 1 is an top view of the game board.

When referring to the figures like reference numerals designate like elements throughout. While the different figures may illustrate the various embodiments of the present invention, the embodiments illustrated and discussed herein are presented for the sole purpose of enabling one to make and use the invention, are not exhaustive, and should not be understood as limiting the scope of the invention in any way.

In one form of the invention, shown in FIG. 1 the game includes a playing surface 20 comprising a game board 22 preferable forming a circuit, and containing a first 24, second 26, third 28, and fourth corner 30, a rear straightaway 32, a START/FINISH line 34 and a pit row 36, all of which are segmented into lanes 38, which are further divided into individual position markers 40. The playing surface 20, may optionally include forward slides 42, backward slides 44, special instruction squares 46, and card pickup locations 48. The playing surface 20 may further include attached sidewalls 50, around the periphery of the game board to contain the playing pieces. This sidewall is preferably sized to allow for the attachment and support of a set of optional cup holder 52.

Figure 2:
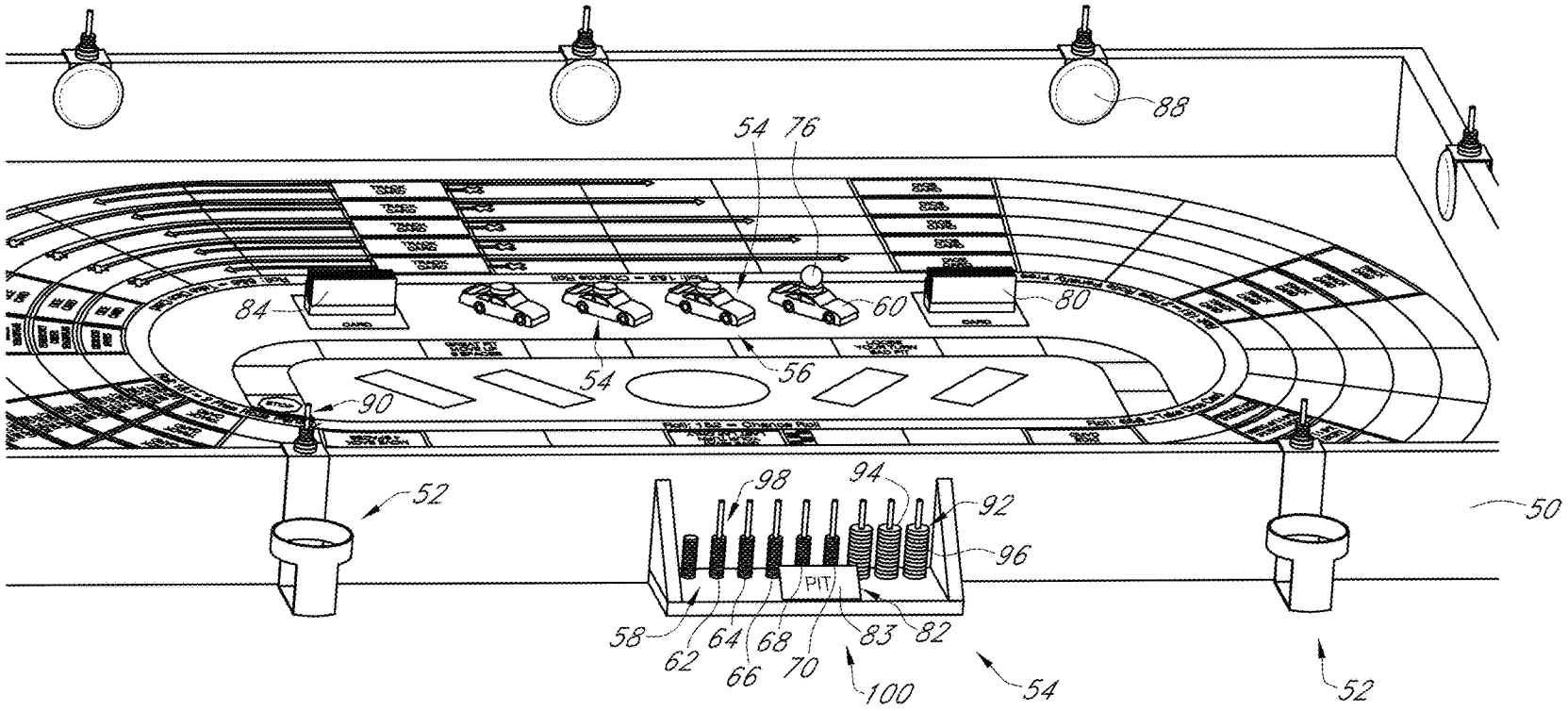
FIG. 2 is a perspective view of the game board showing the playing pieces and cup holders.
Figure 3:
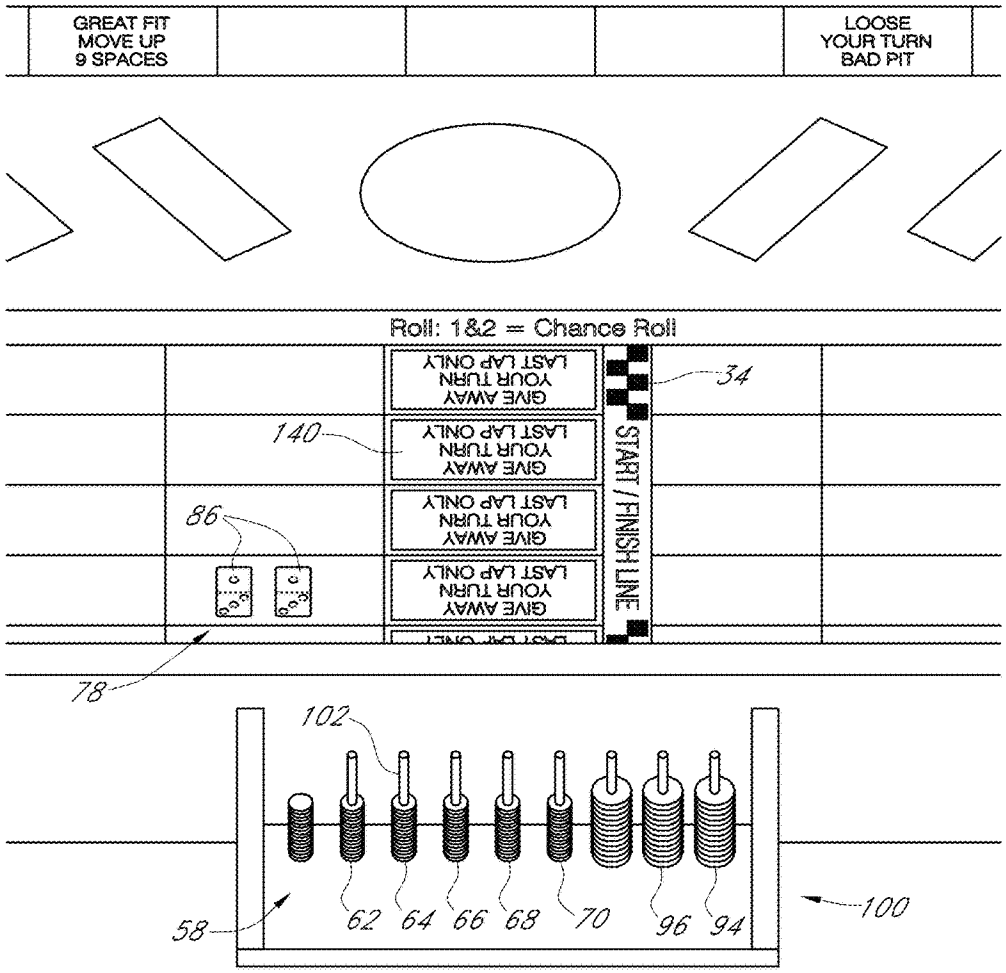
FIG. 3 is a perspective view of the lap markers and pit boss area.
Figure 4:
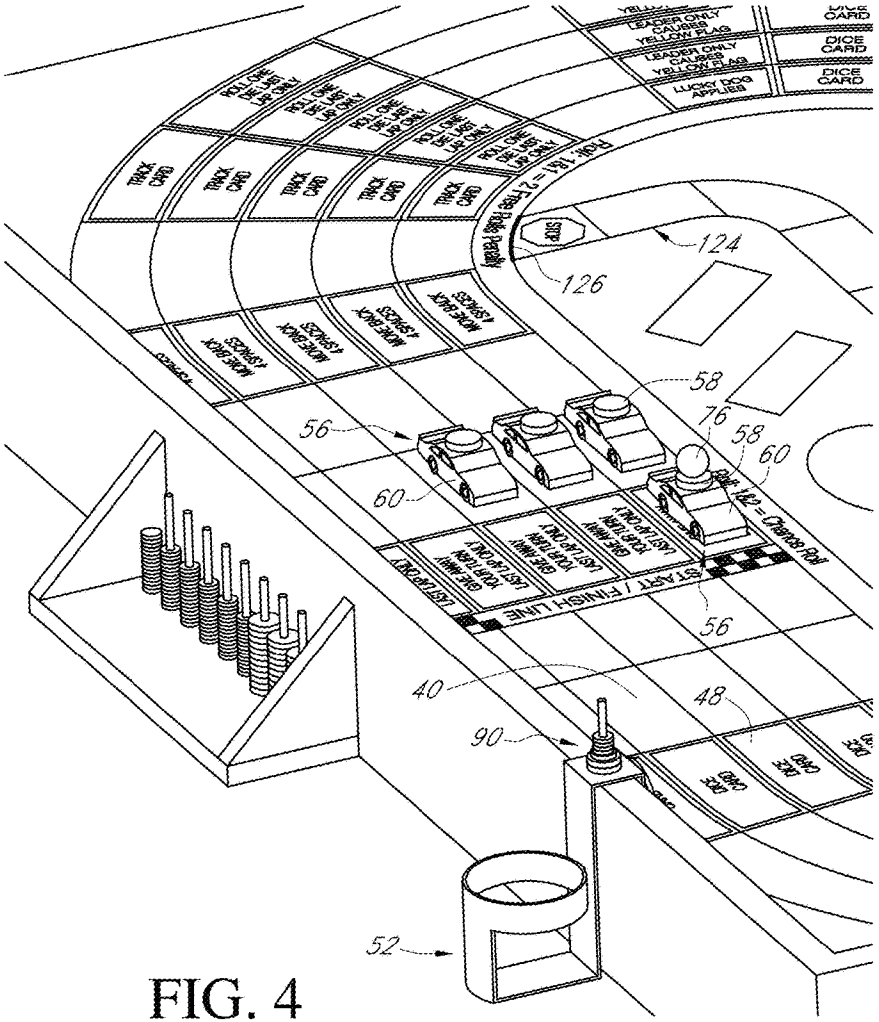
FIG. 4 is a perspective view of the playing pieces on the game board.
Figure 5:
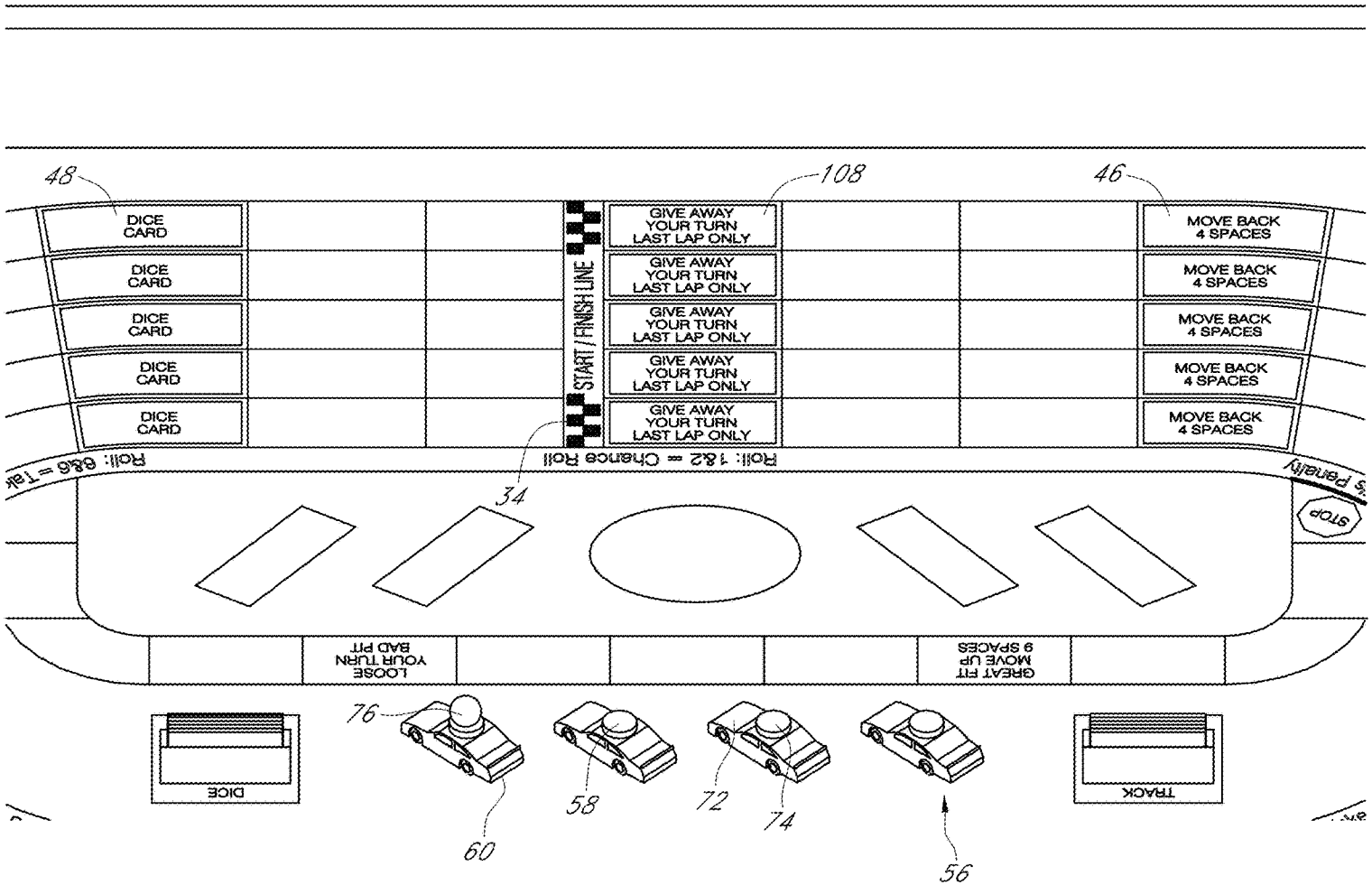
FIG. 5 is a perspective view of the start/finish line and pit row.
Figure 6:
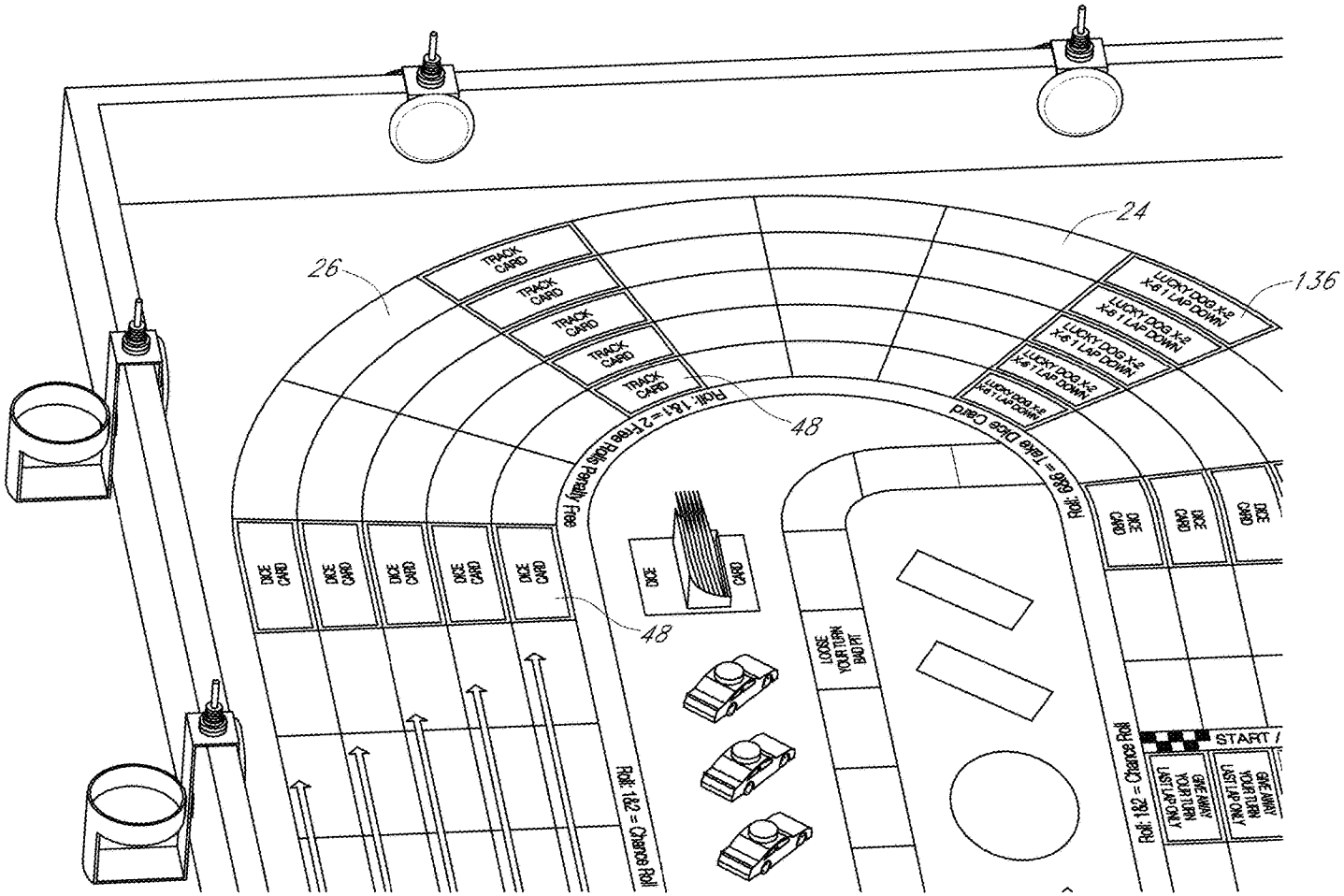
FIG. 6 is a perspective view of the first and second corners of the game board.
Figure 7:
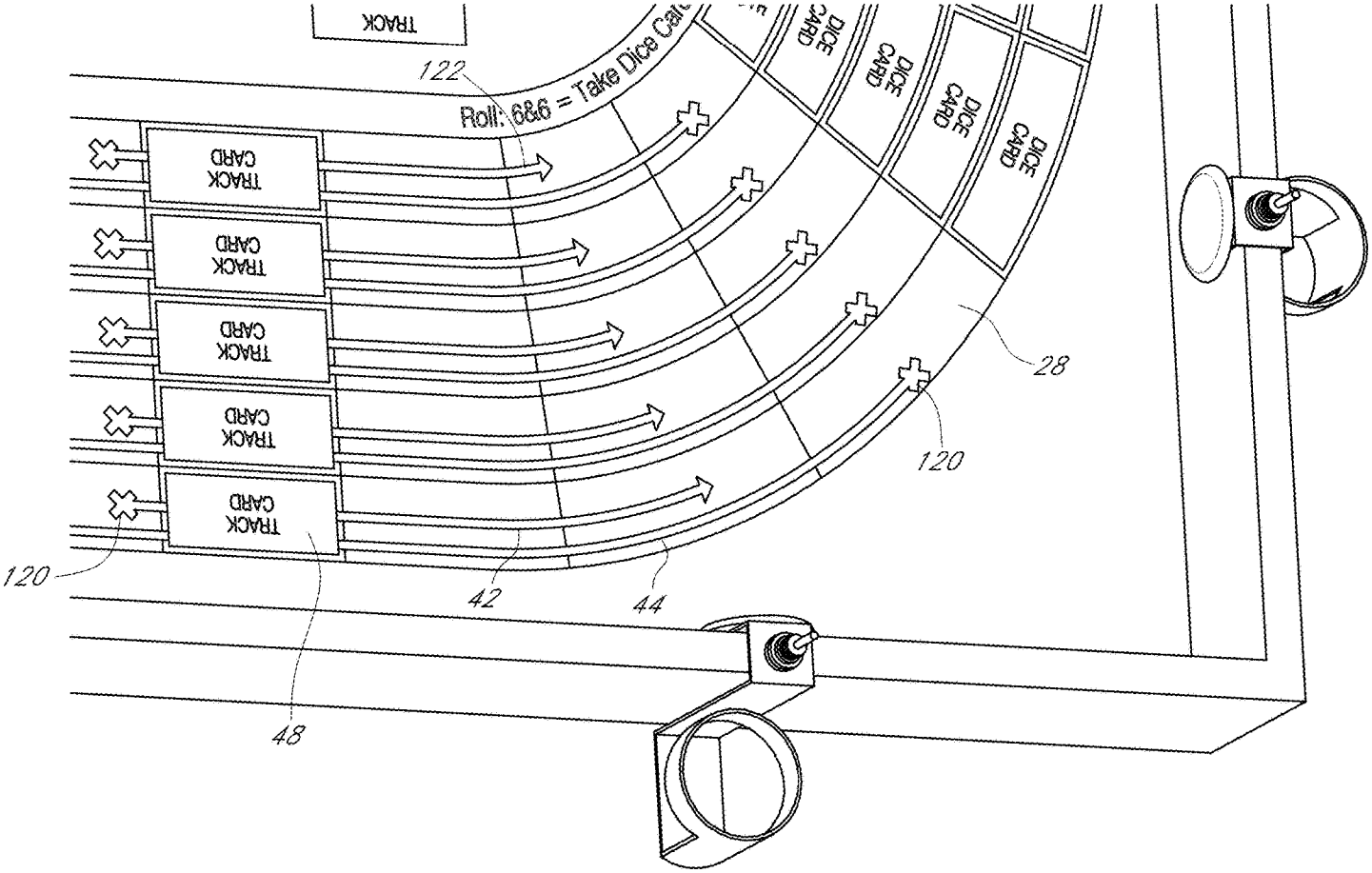
FIG. 7 is a perspective view of the third corner of the game board.
Figure 8:
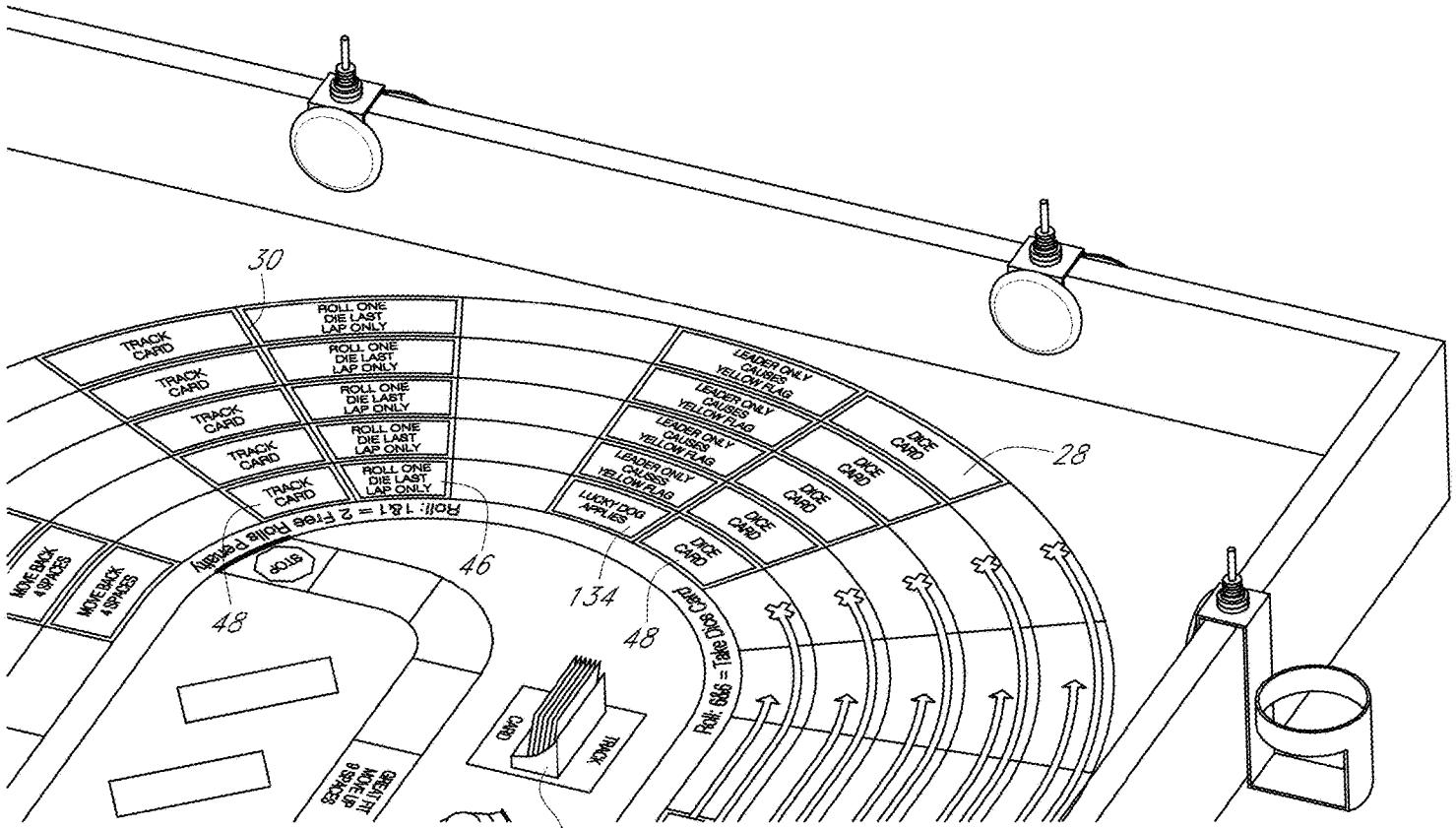
FIG. 8 is a perspective view of the third and fourth corners of the game board.
Figure 9:
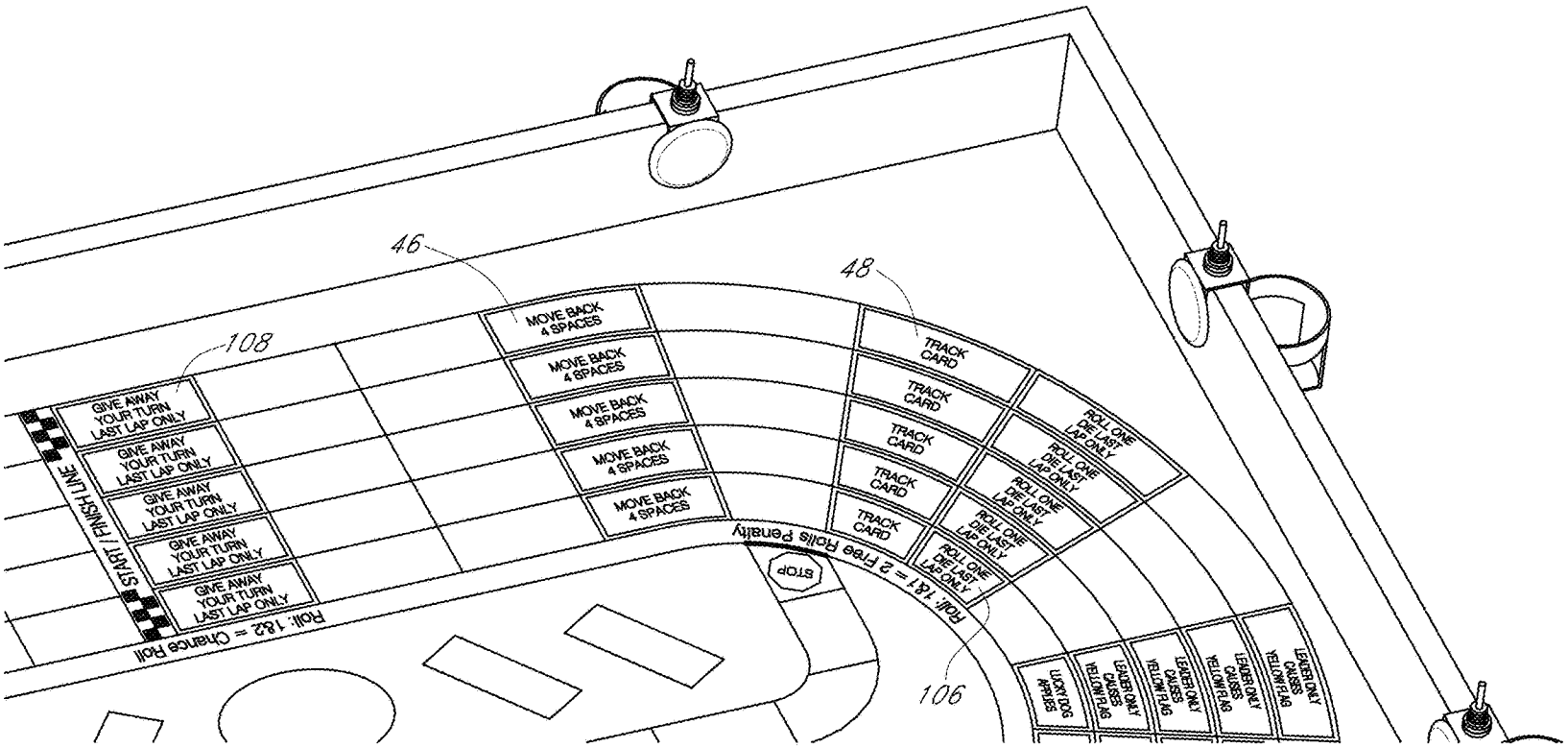
FIG. 9 is a perspective view of the fourth corner of the game board.
Figure 10:
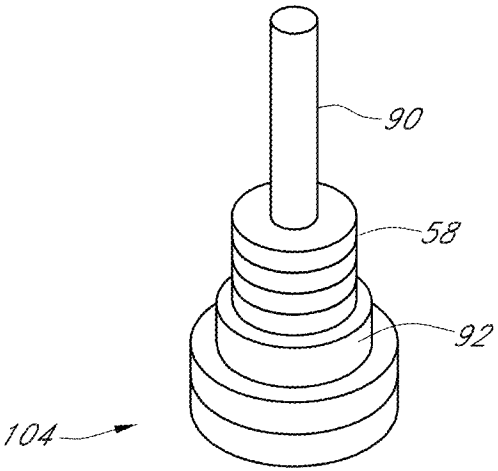
FIG. 10 is a perspective view of an indicating pole.

The game includes playing pieces 54 which comprise position marking indicators 56 and lap indicators 58, which are shown in FIGS. 2 and 3. The position marking indicators 56 are preferably individually numbered cars 60, such as Matchbox™ brand cars. The lap indicators 58, are preferably colored green 62, yellow 64, orange 66, red 68, and blue 70 to indicate the progress of an individual position indicator 56 on the playing surface 20 and are shown in FIG. 3. A different colored lap indicator is received by the player each time the circuit is completed. The lap indicators 58 are preferably sized for easy attachment to a player's individually numbered car 60, hood 72, or roof 74, and may be magnetized. Similar color markers may also be placed in front of a player on their cup holder 52 (FIG. 2) or on an indicating pole 104 (FIG. 10) as an additional reference. The playing pieces also preferably include a 'pole position' marker 76 which is attached to the position marking indicator 56 which is currently leading the race.

Figure 14:
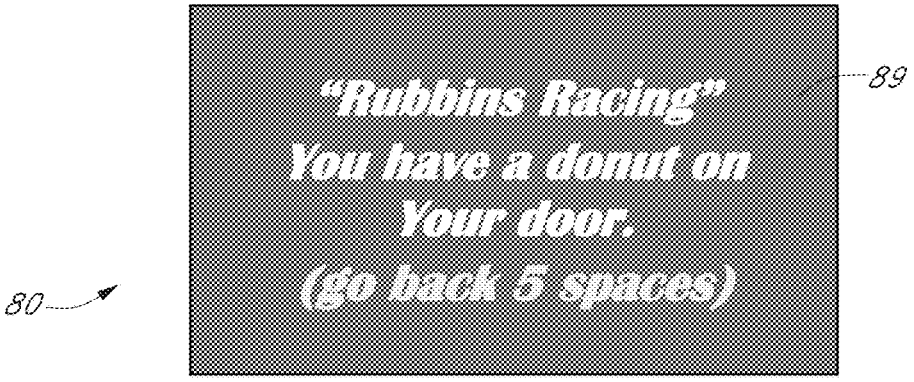
FIG. 14 is a top view of another Dice Card causing a player to move backward.
Figure 15:
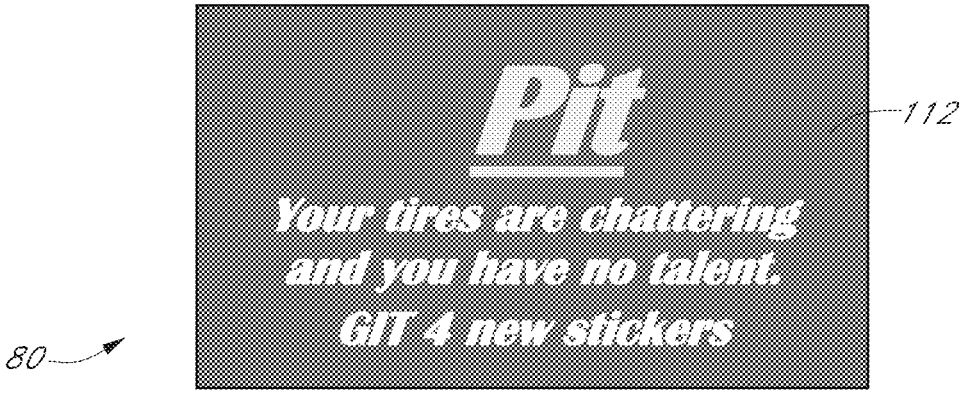
FIG. 15 is a top view of another Dice Card causing a player to Pit.
Figure 16:
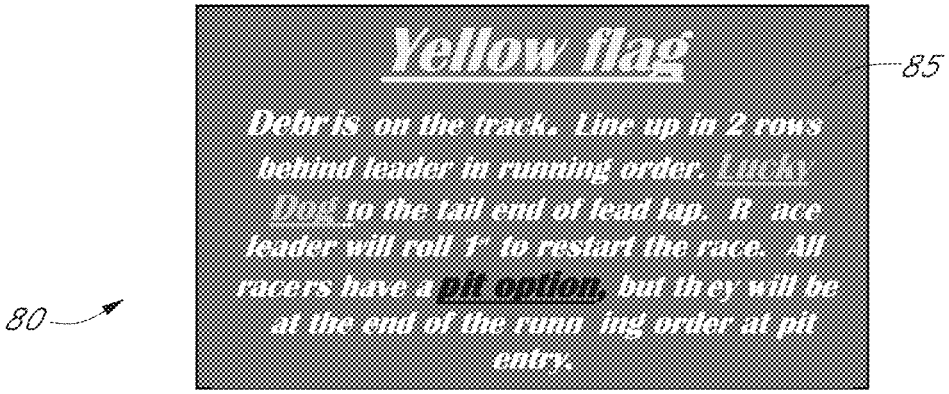
FIG. 16 is a top view of another Dice Card causing a yellow flag condition.
Figure 17:
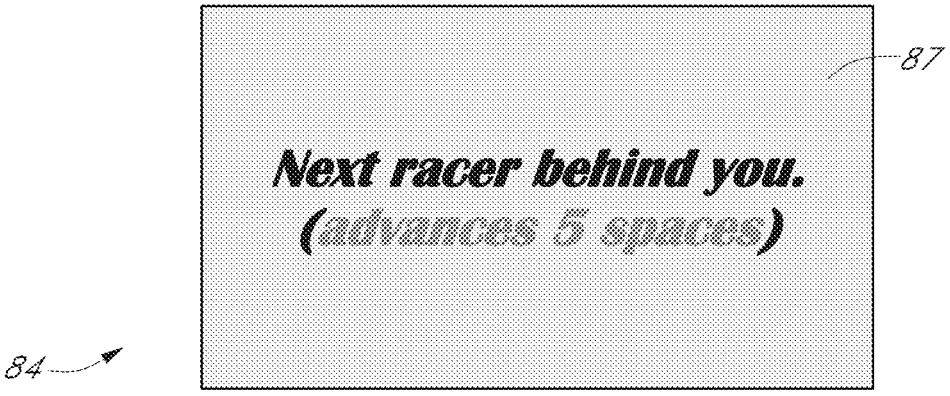
FIG. 17 is a top view of a Track Card causing a player to move forward.
Figure 18:
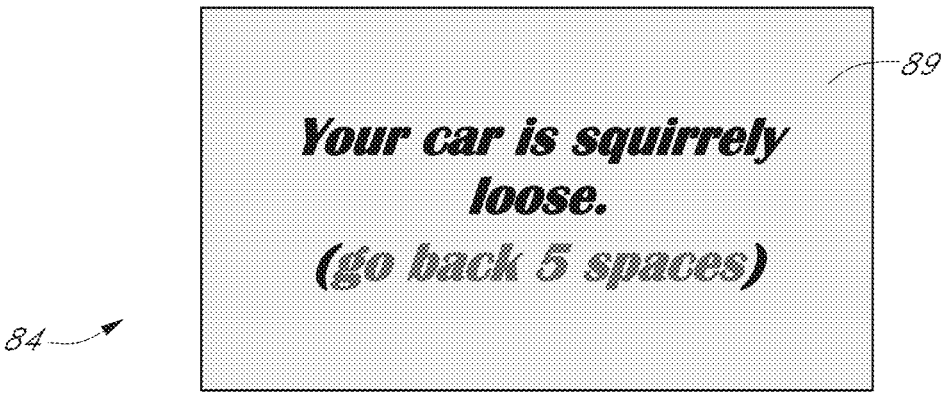
FIG. 18 is a top view of another Track Card causing a player to move backward.
Figure 19:
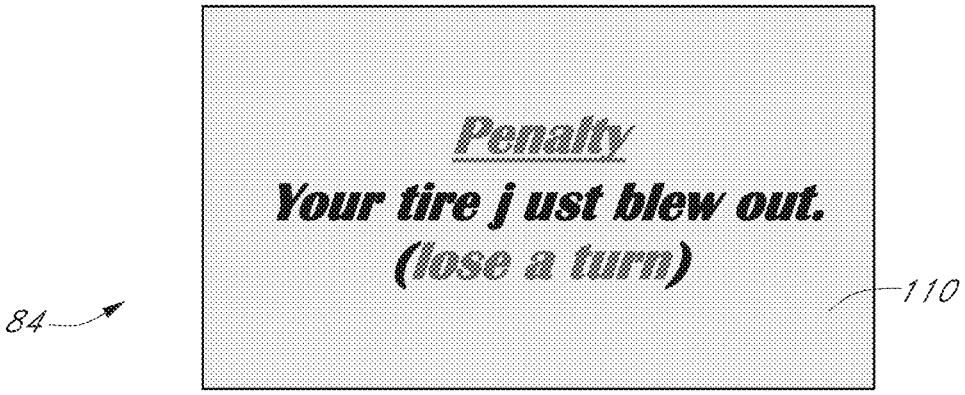
FIG. 19 is a top view of another Track Card causing a player to lose a turn.
Figure 20:
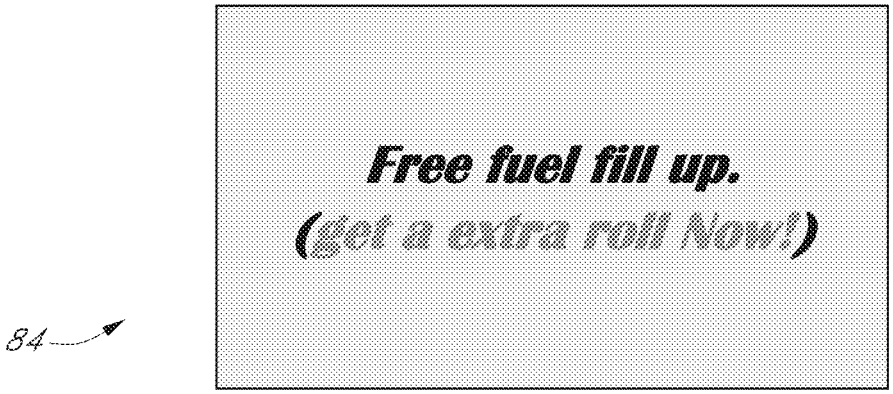
FIG. 20 is a top view of another Track Card causing a player to take an extra roll.
Figure 21:
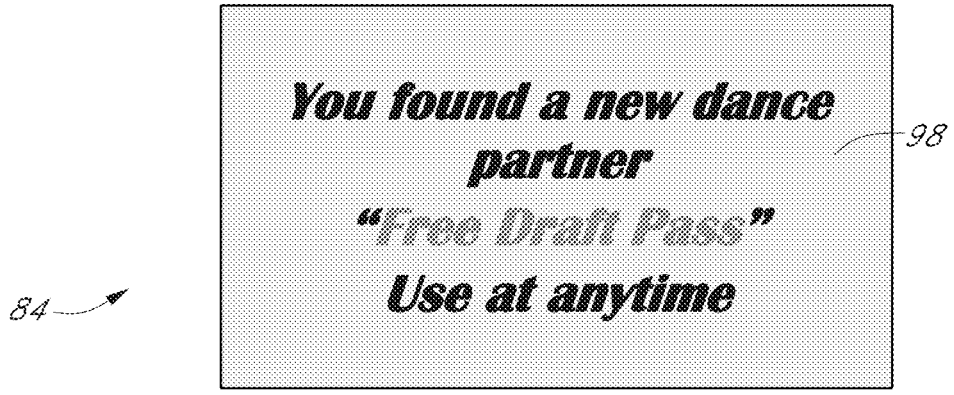
FIG. 21 is a top view of another Track Card giving the player a 'Free Draft Pass'.
Figure 22:
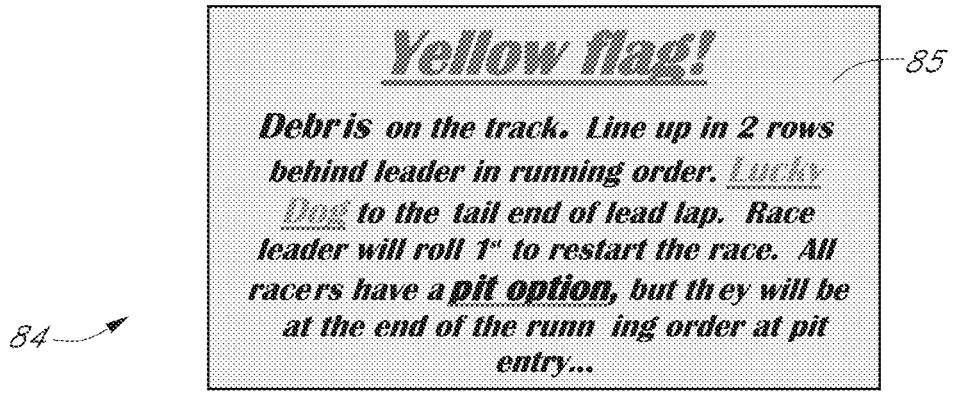
FIG. 22 is a top view of another Track Card causing a yellow flag condition.
Figure 23:
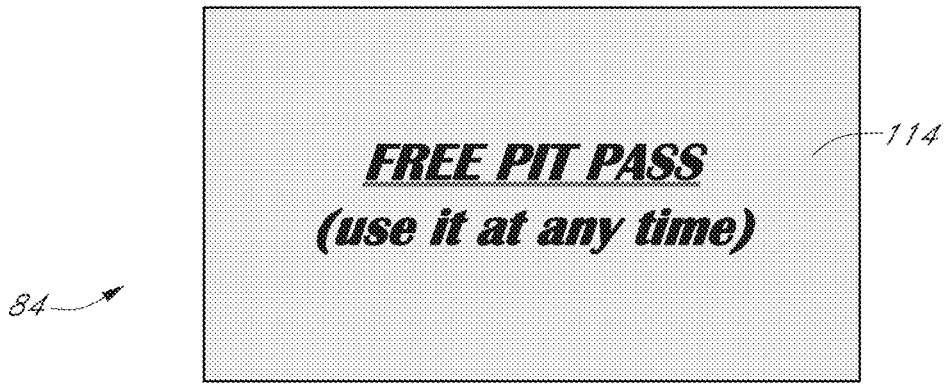
FIG. 23 is a top view of another Track Card giving the player a 'Free Pit Pass'.
Figure 24:
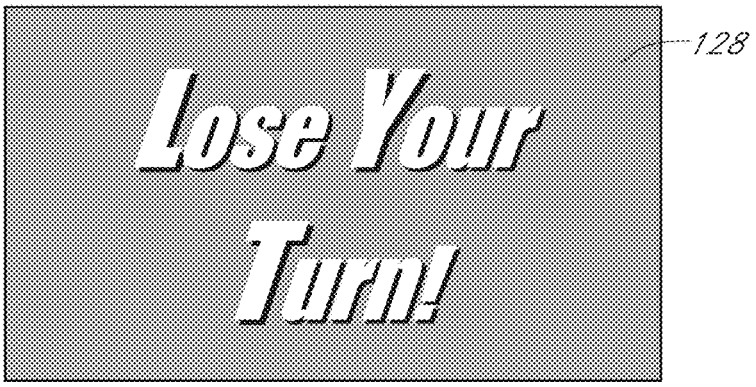
FIG. 24 is a top view of an indicator card, indicating that a player will 'Lose Your Turn'.
Figure 25:
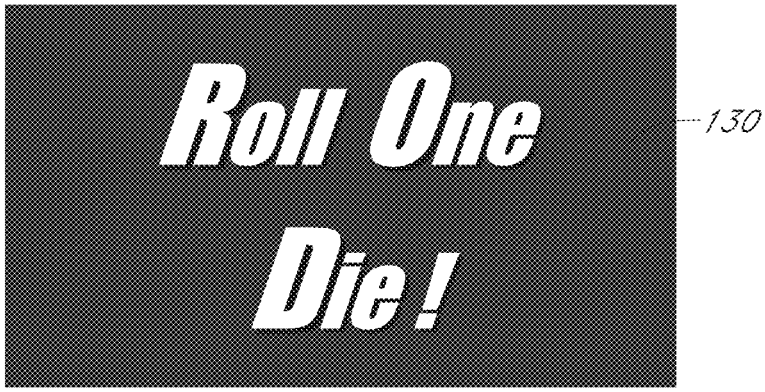
FIG. 25 is a top view of an indicator card, indicating that a player will 'Roll One Die'.
Figure 26:
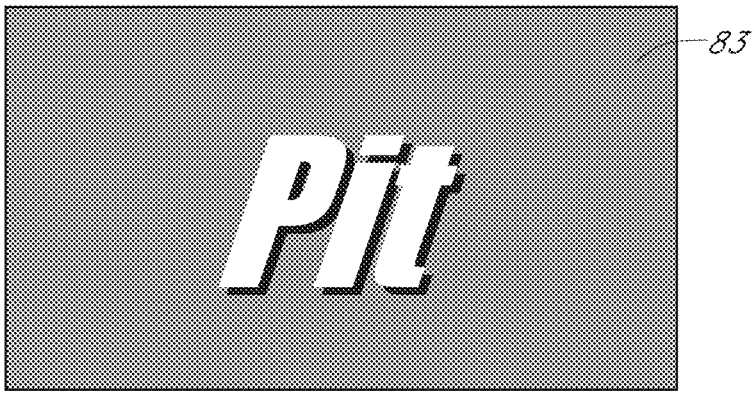
FIG. 26 is a top view of an indicator card, indicating that a player must enter the 'Pit'.

Also included in one form of the invention are randomizing devices 78, which may include: Dice Cards 80; Track Cards 84; as well as conventional dice 86, preferably containing six-sides (shown in FIG. 3). These randomizing devices are used to control the movement of position marking indicators 56 around the game board's position markers 40 according to the method presented below. In the disclosed embodiment of this invention, Dice Cards 80 are disclosed in FIGS. 14-16 and generally modify game play by causing a player to move forward, backwards, switch with another player, or lose a turn. Dice Cards 80 are acquired by landing on certain locations of the game board's position markers 40, and through certain combination of dice rolls, such as double sixes. Dice Cards 80 are capable of initiating a 'yellow flag' condition 85, and can cause a car to be forced to enter pit row 36. Similar to Dice Card 80, are Track Cards 84, shown in FIGS. 17-23, which generally modify game play by causing a player to move forward 87, backwards 89, switch positions with another player, lose a turn 110, or cause a yellow flag condition 85 resetting a portion of gameplay. While generally similar to Dice Cards 80, Track Cards 84 can only be earned by landing on certain locations of the game board's position markers 40. Since Dice Cards 80 and Track Cards 84 can modify gameplay, conditional indicator cards 82 such as Pit 83, Roll One Die 130, and Lose a Turn 128 (shown in FIGS. 24-26) are handed out by the pit boss and placed on the cup holder 52 or indicating pole 104 to serve as a visual reminder to the players of the current status.

Figure 11:
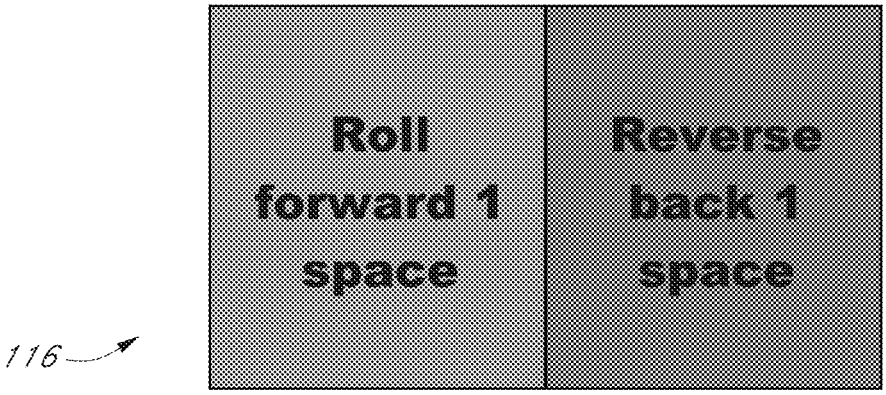
FIG. 11 is a top view of a Roll card.
Figure 12:
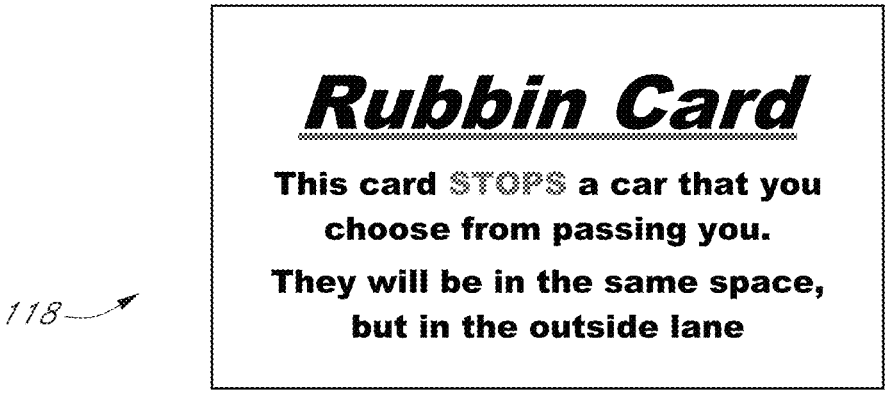
FIG. 12 is a top view of a Rubbing Card.
Figure 13:
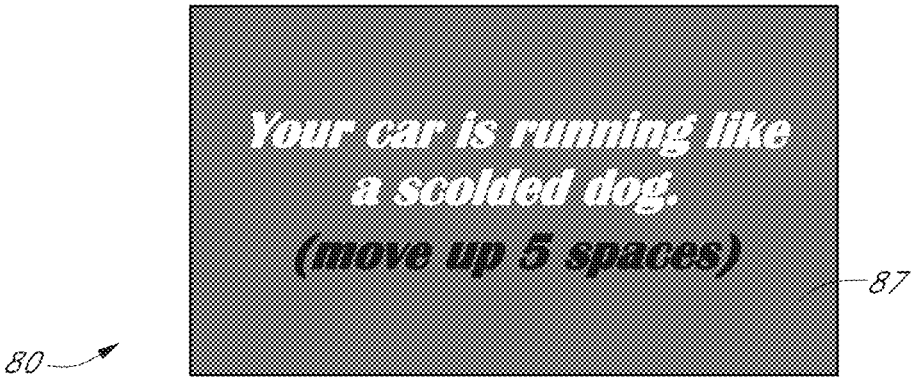
FIG. 13 is a top view of a Dice Card causing a player to move forward.

The current embodiment of the game also features Roll Cards 116 (FIG. 11) and Rubbing Cards 118 (FIG. 12) which add a strategic element to the gameplay. These cards are provided to every player at the beginning of the game and are each useable only once during game play. Roll Cards 116, also known as Roll Forward/Roll Backward cards, are usable on a player's turn to allow the player to adjust a dice roll by +1 or −1, in essence allowing the players movement to come up shorter to longer as needed to take advantage of, or avoid, a particular location on the playing surface 20. Rubbing Cards 118, are only usable on another players turn when another player attempts to move past a player's position marking indicator 56 in an adjacent lane 38. The Rubbing Card 118 simulates an aggressive driving technique used to arrest the forward motion of another player and causes the moving player's turn to end with their position marking indicator placed adjacent to the non-moving player on the outboard lane 38 of the playing surface 20.

A pit boss station 100 may also be included on or attached to the playing surface 20, preferably via attachment to the side wall 50 as shown in FIG. 2. The Pit Boss Station 100 is preferably located near to the START/FINISH line 34 (See FIG. 3) and is clearly marked on the side wall 50 of the game board 22 if included (See FIG. 2). The Pit Boss Station 100 is a location where all spare playing pieces 54 may be stored, ideally by color and type on storage rod's 102 similar in size to the rods 90 used on the cup holders 52.

In an alternate embodiment of the game, the cup holders 52 (See FIG. 2) may be replaced with indicating poles 104 (FIG. 10), each of which contain a rod 90 onto which lap indicators 58, pit indicators 92 (red tire 94, or black tire 96), conditional indicator cards 82, and car number indicator 88 may be installed. Indicating poles 104 allow for instant correlation between a player, their numbered car 60 and their cars progress on the playing surface 20. A black tire 96 or red tire 94 may also be placed on the rod 90 to indicate if an individual player is required to pit or is barred from additional pitting before completing the race. Indicating poles 104 are preferred over cup holders 52 when the playing surface 20 does not contain a sidewall 50, such as when the playing surface 20 is printed on a roll up mat.

Exemplary Method for Playing One Form of the Name:

In its simplest form, the game is played by following a basic set of rules, wherein the first player to cross the START/FINISH line 34 after completing a course laid out on the playing surface 20 is the winner. An exemplary race course is shown in FIGS. 1-9.

To begin, the playing surface 20 containing the game board 22 is placed onto a level surface. The players nominate a Pit Boss, who will be stationed in front of the pit boss station 100 and will be responsible to hand out lap markers 58, pole position markers 76, black tires 96, red tires 94, as well as indicator cards 82. This player will remain the pit boss for the entirety of the race. The players determine the number of laps to be raced.

Each of the players then takes a single die and rolls to determine who has 'pole position' or is the lead player. The person who rolls highest 'has the pole', and will play first. The next highest roll is in second place, and so forth. If there is a tie for an individual number, the tied players roll again, and the higher roller gets to go before the other formerly tied player. The players then stage in their playing order around the table, with the pole position furthest on the left, and the last player furthest to the right. The arrangement is staged around the pit boss, and the pit boss station 100. For example, if the pit boss rolls such that he will play third, the holder of the pole position will stand two places to the left of the pit boss, the 2nd in place is directly to the left of the pit boss, the pit boss stands in front of his/her station 100, and the remaining players stage to his/her right in increasing order around the playing surface according to their pole position order. The car in the 'pole position' is then given the 'pole position' marker 76, which is attached to this player's position marking indicator 56.

Each player is also assigned a cup holder 52 or indicating pole 104 with a rod 90, preferably a spring rod, fitted with one black tire 96. This black tire 96 serves to indicate that the player must enter pit row 36 prior to completing the race. Each player will receive one 'Black Tire' 96, per race, and will place the black tire 96 onto their rod 90. Each player then places a car number indicator 88 on a display mounted on the front of their cupholder 52, on the indicating pole 104, on a pin, tag, or necklace worn by the player. The indicator 88 identifying the player's position marking indicator 56 sharing the number shown on their individually marked car 60. If using the cup holder, the cup holder may optionally be installed onto the sidewall 50 of the playing surface 20.

The game begins when the player in the 'pole position' rolls two dice and moves their position marking indicator 56 (preferably an individually marked car 60) according to the total of the two dice 86. At the completion of the move, the player acts upon any forward slides 42, backward slides 44, special instruction squares 46, or card pickup locations 48 located on the playing surface 20 underneath their position marking indicator 56. Special instruction squares 46, indicate the particular action the player is to take directly upon the playing surface 20; and in one embodiment of the invention a subset of these special instruction squares 46 are only active on the player's last lap of the game. Special instruction squares may include, but are not limited to: 'roll one die—last lap only' 106; and 'give away your turn—last lap only' 108. The player's turn ends upon their completion of the actions indicated on any cards or by the playing surface after they have completed their move. Play then passes to the second player and so on in order until all players have completed their first turn. Play then returns to the first player and continues in this order until the game is completed, or a 'yellow flag' condition is created resetting the order of play.

During a roll, if a player rolls 'Doubles', the player must roll and move a second time. If this roll was 'Double-Sixes', then the player moves forward twelve spaces, and then immediately draws a 'Dice Card' 80 (See FIGS. 13-16) and performs the instructions shown on the card. A player will continue rolling until a non-doubles roll is performed or a Dice Card 80 ends his/her turn. If a non doubles roll is achieved, the player will move a number of spaces indicated by the non-doubles dice total and their turn will end. If the player's move places their position marking indicator 56 ahead of a car with the pole position indicator 76, and the moving player is on the lead lap, the pole position indicator 76 is transitioned to the car now in the lead.

A player rolling double-ones ('Snake Eyes') gets to move forward two spaces without penalty. This means the player may ignore any negative special instruction squares 46 and negative slides 44 their position marking indicator may 56 stop upon. After the player moves the first two spaces, the player must take two additional rolls, also without penalty. Doubles rolled on the first additional roll count only for their total movement and do not grant an additional roll or cause the player to draw a 'Dice Card' 80. The second additional roll is also moved without penalty; however if doubles are rolled on the second additional roll, the player must roll again, and the results of this third roll are penalized normally, including taking a 'Dice Card' 80 upon rolling 'Double-Sixes'. Any roll in the set of two additional rolls that is another 'Snake Eyes' (Double 1's), will reset the number of free rolls, cause the player to move forward two spaces, and then take two additional penalty free rolls. If either the first or second free 'Snake Eyes' rolls indicate a roll of '1-2' (i.e. a total roll of 3), the player must move ahead three spaces and cannot take advantage of the 1-2 chance opportunity (see below). If the player in lead position lands on "Leader Causes Yellow Flag" during either free roll, the game continues without a yellow flag penalty.

A roll of dice, which totals to exactly 3 (i.e. '1-2 Chance'), allows the player the choice to move forward three spaces, or to roll again. However, if a re-roll is elected, and the re-roll indicates any type of doubles, the player must move backwards an amount indicated by the roll on the dice. Otherwise the player's highest die on the re-roll is doubled and the player's position marking indicator 56 is moved forward according to twice the amount of the highest die. For example, on a roll of 3, a player may elect to move forward 3 or to re-roll. On a re-roll, if the total was double-threes, then the player moves backwards six places. Alternately, if on the re-roll, the dies indicate a two and a three, the highest die (three) is doubled (to six) and the player moves forward six spaces.

At the completion of a player's move, if their position marking indicator 56 is located in the space behind another player's position marking indicator 56, even if in a different lane 38, the moving player may elect to 'Draft' with the car in front of it, forfeiting their next turn unless they possess a 'Free Draft Pass' card 98. A player cannot draft if they draw a 'Lose a Turn' card 110. Players are free to draft cars that are already drafting another car, but must elect to separate or follow the car that is directly ahead of them. Once a player has elected to 'Draft', the player's car moves with car directly in front of them. Thus, during the opposing player's turn, instead of moving only their position marking indicator, the opposing player moves both players' position marking indicators 56, with the drafting player's position marking indicator 56 remaining one space behind the opposing player's (leading car's) position marking indicator 56. The drafting player ignores backward slides 44, special instruction squares 46, or card pickup locations 48 located on the playing surface 20 under its position marking indicator 56 while drafting. The drafting car is subject to any beneficial effects incurred by the leading car, such as forward slides 42 located on the playing surface 20 under the leading cars position marking indicator, but ignores any negative effects such as backwards slides 44. However, if the leading car lands on a card pickup location 48, the following player must choose to either: a) stop 'Drafting'—stopping at their current position on the board and not subject to the benefits or penalties listed on the 'Dice Card' 80 or 'Track Card' 84; or b) continue 'Drafting'—subject to any penalty or benefit the leading car's player is subjected to, and continuing to remain one space behind the opposing player.

'Track Cards' 84 and 'Dice Cards' 80 (FIGS. 13-23) represent the various facets of racing which are difficult to represent via dice 86 alone. These cards are drawn when a player lands on a card pickup location 48 on the playing surface 20, or in the case of 'Dice Cards' 80, when the player rolls Double-Sixes. These cards are drawn, read, and the instructions followed at the completion of the player's movement according to the dice rules provided above. These cards typically add forward or negative movement to the player's position marking indicator 56, or may cause two players to switch places. A 'Free Draft Pass' card 98 is included, and allows a player to save the card and execute a draft behind another player without forfeiting a roll on their next turn. A 'Free Dice' and a 'Free Track' card are also included, and allowing a player to ignore instructions requiring them to take a Dice 80 or Track 84 card. Cards indicating 'Pit' 112 in their instructions require the player to complete the current lap, entering 'Pit Row' 36 as soon as possible, unless the player holds a 'Free Pit Pass' 114 card or a Red Tire indicator 94. A player holding a red tire 94 may ignore any 'Pit card' 112 instructions. If a player encounters a "roll one die" instruction, that player may only roll one die on next turn until they complete a pit stop (the player will be handed a 'Roll One Die' card 130 by the pit boss). Cards indicating "Yellow Flag" 85 cause a 'Yellow Flag' condition on the track, and all players follow the instructions listed on the card.

If the instructions on a 'Dice Card' 80 or 'Track Card' 84 move a player onto a card pickup location 48, the player might be penalized a second time. In order to avoid this "Double Jeopardy" situation, the player, without looking at the new card, must select another competitor to pass the card to. The first player then completes their turn normally. The pit boss will then hand a 'Double Jeopardy' indicator card to the card's recipient indicating that they must play their turn normally, and at the completion of the turn, they must read and execute the instructions on the card given to them by the first player. The 'Double Jeopardy' indicator card is then returned to the pit boss.

Slide locations are preferably included on the playing surface 20 and include Forward Slides 42, Backward Slides 44. A player completing their turn on the 'X' portion 120 of a slide 42, 44 will then move their position marking indicator 56 to the end portion 122 of the slide in the direction of the arrow completing their turn. A player who is 'Drafting' will slide if the lead car is subject to the slide 42 and will remain one position behind the lead car at all times. If however, the leading car encounters a rearward slide 44, the draft is broken, the formerly drafting car remains in its current location, and the formerly leading player, slides from the 'X' 120 to the end of the arrow 122 behind the formerly drafting player. Forward slides 42 are preferably sized to move a player forward 3 spaces, while backwards slides 44 are preferably sized to move a player backwards 6 spaces.

Each time a player crosses the START/FINISH line 34, a lap marker 58 is added to their cup holder's 52 or indicating pole's 104 rod 90. A similarly colored indicator is then attached to the position marking indicator 56. In the case of an individually numbered car 60, the lap marker 58 is preferably attached to the hood 72 or roof 74 of the car. These indicators are supplied by the Pit Boss, from the Pit Boss Station 100, and are used to track a player's progress during the race. In the preferred form of the invention, Green indicators 62 are used for lap 1, yellow 64 for lap 2, orange 66 for lap 3, red 68 for lap 4, and blue 70 for lap 5. If additional laps are needed, the markers are recycled and used in the same order.

During the race, each player must enter 'Pit Row' 36 at least once per race. At the start of each race, each player is provided with at least one black tire 96 indicator which is placed on their cup holder's 52 rod 90. This indicates that the player has not yet pitted. Once the player enters pit row 36, their 'Black Tire' is returned to the pit boss. If the same player again returns to the pit, a 'Red Tire' 94 is issued to the player indicating that they have pitted twice. Once a player has received a red tire 94, they may ignore any further 'Pit' cards 112, and may continue racing without having to pit again for the remaining duration of the game. Additionally, if a player is on the last lap of the game and has pitted at least once (returned their black tire 96 indicator to the pit boss), that player may ignore further 'Pit' cards 112. If the players agree to increase the game by a greater amount of laps, the minimum number of mandatory pits may be increased at the discretion of the Pit Boss. For example, a twenty lap race may require a minimum of 3 mandatory pits, rather than 1 mandatory pit for a five lap race.

In order to complete a pit stop, a player must enter 'Pit Row' 36 by progressing to the pit row entry point 124, which contains a 'Stop Location' 126. Any roll that brings a player to the stop location at the pit's entryway will complete that player's turn, even if 'Doubles' were rolled. 'Double-Sixes' in this instance will not incur a 'Dice Card' 80. They may enter pit row 36 on their next turn. Once inside Pit Row 36, a player may roll and play normally including 1-2 chance and 'Snake Eyes', however they may not draft and double sixes will not incur a dice card 124. Once a player enters the 'Pit Row' exit 132, they may return any 'PIT' cards 112 in their possession to the pit boss and return/receive a tire marker as needed. Note: one may not complete a race from within pit row, thus if a player enters pit row 36 on their final lap, they must complete one additional lap to complete the race.

A yellow flag condition is caused when a player draws a 'yellow flag card' 85, or when the car with the pole position marker 76, ends a move on the spot containing the "Leader causes the yellow flag" 134 square. A 'yellow flag' condition represents an accident condition on the track, which causes all cars to slow down and line up in two rows behind the position marking indicator 56 with the pole position marker 76 (the lead car). If two or more players are in adjacent lanes 38, the player on the inside lane gets the better position. Condition cards (Dice or Track cards) indicating for a player to roll one die or lose a turn are discarded, however players in possession of a Pit Card 112 must pit if possible and do not discard the Pit Card 112 until they enter 'Pit Row'36. If a player's position marking indicator 56 would pass the entry to pit row 36 on its way to the line up behind the lead car, they may elect to stop at the entry way to 'Pit Row' 36 instead of entering the line-up. Any player's position marking indicator 56 currently located in 'Pit Row' 36 may immediately exit 'Pit row' 36 and move into the running order position in the lineup. A player who is currently stopped at stop location 126 waiting to enter Pit Row 36, does not advance into the lineup and must remain at the entry to pit row. If the player currently in the pole position is in the pit, and another player causes a yellow flag, the other players lineup on the track in the correct running order, in line with the leaders position on pit row 36 leaving an opening for the lead car as if he/she were on the track. Any player who is one or more laps behind the player with the pole position marker 76 (lead car), must allow players on the lead lap to move ahead of them in the lineup. After the lineup is determined, all players remove their cup holders 52 from the attached sidewalls 50, or pickup their indicating pole 104 and shift positions around the pit boss and the pit boss station 100 similar to the initial game setup, adjusting to the new running order of the lineup. The players then reattach their cup holders to the side wall 50, and play resumes with the player in the pole position rolling first, and so on in the order determined by the lineup.

When a 'yellow flag' condition occurs, and a player is one lap behind the lead player, the last player to be passed by the leader is considered to be the "Lucky Dog". This player advances one lap and is placed into position as the last car on the lead lap. Further adding to the excitement, the playing surface 20 includes a 'Lucky Dog' Indicator 136. When a player lands in this space, and is currently on the lead lap (same lap as the lead player), the player's roll on their next turn is multiplied by 2. If the player that lands on the Lucky Dog Indicator 136 is not on the lead lap, the player's roll on the next turn is multiplied by 5 but is restricted from advancing any further than one space ahead of current leader. If this move would place the player ahead of the car with the 'Pole Position Indicator' 76 (lead player), move the pole position indicator 76 to the moving player's position marking indicator 56 and place the indicator one space ahead of the other player's position marking indicator. A player may draft a car landing on the Lucky Dog Indicator 136 and may continue to follow the lead car through the multiplied roll. Should the player roll happen to roll a 1 & 2 combination (i.e. a total roll of 3) on the Lucky Dog Indicator 136, the player must move forward either 2×3=6 spaces if on the lead lap, or 3×5=15 spaces if not on the lead lap—as the '1-2 Chance' rule does not apply to a 'Lucky Dog' roll.

During the last lap of the race, if a player's roll indicates that they will land on the 'Give Away Your Turn—Last Lap Only' indicator 108 or 'Roll One Die Last Lap Only' indicator 106, the player may not play a Roll Card 116 to avoid this result. If the player encounters the 'Give Away Your Turn—Last Lap Only' indicator 108, the player will forfeit their next roll and designate another player to receive a 'free roll' in their stead. On their next turn the player will resume rolling and continue their movement across the START/FINISH line 34. The game is won by the first player to cross the START/FINISH line 34 after completing the agreed upon number of laps around the playing surface 20 and having pitted the required number of times. Second place is awarded to the next player to complete the requirements and cross the START/FINISH line 34, and so on until all racers have completed the race.

Errors or omissions during a player's turn, such as moving an incorrect number of spaces, become final once the next player in sequence rolls the dice. In the case of a missed 'Double Jeopardy' card, the player holding the card will read and use it on their next available turn. If a situation arises where a movement is challenged, or a question arises as to whether a player has completed a requirement for the race (such as pitting), the pit boss will make the final decision as to the best remedy for the situation. The pit boss is the final judge of all issues regarding game play.

Accordingly, it will be understood that the invention is not limited to the embodiments disclosed herein, but is to be understood from the claims, the preceding description, and the figures, each of which are to be interpreted as broadly as allowed under the law, including the doctrine of equivalents.

The invention claimed is:

1. An automobile racing board game for a plurality of players comprising:

a playing surface imprinted with indicia representing a closed circuit race track having a start/finish line and a plurality of adjacent lanes, each of said lanes further divided into an equal number of individual position markers around the circuit;

said playing surface further comprising a pit row which is a single position marker wide and located adjacent to said start finish line, said pit row further having an entrance and exit location connected to said race circuit, wherein said entrance location further contains a stop location;

a plurality of position marking indicators placed onto said playing surface and representing a player's position on one of said individual position markers, wherein said plurality of position marking indicators are car shaped and have a different number marked thereon to distinguish one position marking indicator from another;

a set of dice cards corresponding to a dice card pickup location on said playing surface;

a set of track cards corresponding to a track card pickup location on said playing surface;

a roll one die condition indicator card corresponding to a roll one die condition causing location on said playing surface;

a lose a turn condition indicator card corresponding to a lose a turn condition causing location on said playing surface;

a first set of lap indicators attachable to said plurality of position marking indicators;

a random number generator;

a plurality of repositionable indicating poles each attached to their own support base, wherein the number of repositionable indicating poles is equal to the number of position marking indicators on the playing surface;

a second set of lap indicators attachable to said repositionable indicating poles via a hole placed through each of said second set of lap indicators, said second set of lap indicators comprising at least five different shapes, numbers, or colors for indicating the number of times a player has crossed said start/finish line and wherein the second set of lap indicators further comprises a quantity of each shape, number, or color equal to or exceeding the number of position marking indicators;

a sidewall surrounding said playing surface;

a plurality of repositionable cup holders each having a hanging hook having a front face displaying a number corresponding to one of said numbers marked upon each of said position marking indicators, said hanging hook fitted to a location along a top edge of said sidewalls; and wherein one repositionable indicating pole is attached to each of said repositionable cup holders allowing the assembly of said cup holder and said indicating pole to be repositioned along said sidewall during game play and wherein each of said repositionable indicating poles receives and displays at least one of said second set of lap indicators.

2. The automobile racing board game of claim 1 wherein said random number generator is a pair of six sided dice.

3. The automobile racing board game of claim 1 further comprising:

a plurality of forward slide indicia printed on each of said adjacent lanes of said playing surface, said slide indicia located on a side opposite the start/finish line; and a plurality of backward slide indicia printed on each of said adjacent lanes of said playing surface, said slide indicia located on a side opposite the start/finish line.

4. The automobile racing board game of claim 1 further comprising:

a plurality of first pit status indicators having a thru hole sized to fit onto said repositionable indicating poles; and a plurality of second pit indicators having a different color or shape from said first pit status indicator, said plurality of second pit indicators also having a thru hole sized to fit on said repositionable indicating pole.

5. The automobile racing board game of claim 1 further comprising:

a pit boss station mounted to said sidewall; and wherein said pit boss station further comprises a plurality of storage rods at least one of which is fitted with at least one of said second set of lap indicators.

6. The automobile racing board game of claim 1 wherein said closed circuit race track is exactly five lanes wide, and wherein each of said dice card pickup locations, said track card pickup locations, and said roll one die condition causing locations are duplicated across each of the five adjacent lanes.

7. The automobile racing board game of claim 1 further comprising a spherical shaped pole position marker attached to at least one of said position marking indicators.

8. The automobile racing board game of claim 1 wherein at least one of said first set of lap indictors is physically attached to each of said position marking indicators, and wherein at least one of said second set of lap indicators is mounted on each of said repositionable indicating poles.

9. The automobile racing board game of claim 1 further comprising a set of conditional indicator cards, said indicator cards placed upon at least one of said cup holders in order to display the indicator card to other players.

10. An automobile racing board game for a plurality of players comprising:

a playing surface imprinted with indicia representing a closed circuit race track having a start/finish line and five adjacent lanes, each of said lanes further divided into an equal number of individual position markers around the circuit, said playing surface surrounded by a sidewall;

said playing surface further comprising a pit row which is a single position marker wide and located adjacent to said start finish line, said pit row further having an entrance and exit location connected to said race circuit, wherein said entrance location further contains a stop location;

a plurality of position marking indicators placed onto said playing surface and representing a player's position on one of said individual position markers, wherein said plurality of position marking indicators are shaped like cars and have a different number marked thereon to distinguish one position marking indicator from another;

a plurality of repositionable cup holders each comprising a hanging hook having a front face further having a car number indicator corresponding to each one of the numbered position marking indicators, said hanging hook fitted to a location along the top edge of said sidewalls and allowing cup holders to be repositioned during game play, said hanging hook further comprising a vertical indicating pole sized to accept one or more indicators;

a set of dice cards corresponding to at least three dice card pickup locations on said playing surface;

a set of track cards corresponding to at least three track card pickup locations on said playing surface;

a roll one die condition indicator card corresponding to a roll one die condition causing location on said playing surface;

a lose a turn condition indicator card corresponding to a lose a turn condition causing location on said playing surface;

a first set of lap indicators attachable to said plurality of position marking indicators, said first set of lap indicators comprising at least five different shapes, numbers, or colors for use in indicating the number of times a player has crossed said start/finish line;

a second set of lap indicators attachable to said indicating pole of said cup holder via a hole placed through each of said second set of lap indicators, said second set of lap indicators comprising at least five different shapes, numbers or colors for indicating the number of times a player has crossed said start/finish line;

a plurality of first pit status indicators having a thru hole sized to fit onto said indicating pole of said cup holder;

a plurality of second pit indicators having a different color or shape from said first pit status indicator, said plurality of second pit indicators further having a thru hole sized to fit on said indicating pole of said cup holder;

a pair of six sided dice;

a pole position marker attached to at least one of said position marking indicators placed onto said playing surface;

a plurality of forward slide indicia printed on said playing surface and located on a side opposite the start/finish line; and a plurality of backward slide indicia printed on said playing surface and located on a side opposite the start/finish line;

a pit boss station mounted to said sidewall closest to said start/finish line, having at least one of said set of first set of lap indicators, at least one roll one die condition indicator card, at least one lose a turn indicator card and further having a plurality of storage rods fitted with at least one of said second set of lap indicators, at least one of said first pit status indicators, and at least one of said second pit indicators.

* * * * *